US006265970B1

(12) United States Patent
Whitehead

(10) Patent No.: US 6,265,970 B1
(45) **Date of Patent: *Jul. 24, 2001**

(54) EVENT DETECTION DEVICE WITH FAULT MONITORING CAPABILITY

(75) Inventor: Matthew Whitehead, Sheffield (GB)

(73) Assignee: Pyronix Limited, Rotherham (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/091,804

(22) PCT Filed: Dec. 20, 1996

(86) PCT No.: PCT/GB96/03179

§ 371 Date: Aug. 21, 1998

§ 102(e) Date: Aug. 21, 1998

(87) PCT Pub. No.: WO97/22957

PCT Pub. Date: Jun. 26, 1997

(30) Foreign Application Priority Data

Dec. 20, 1995 (GB) ..... 9526004

(51) Int. Cl.[7] ..... G08B 29/00

(52) U.S. Cl. ..... 340/506; 340/507; 340/523; 340/526; 340/529

(58) Field of Search ..... 340/506, 507, 340/523, 526, 529, 527, 541; 324/535

(56) References Cited

U.S. PATENT DOCUMENTS

| | | | | |
|---|---|---|---|---|
| 3,775,675 | * | 11/1973 | Freeze | 324/547 |
| 3,789,293 | * | 1/1974 | Freeze | 324/102 |
| 4,365,239 | * | 12/1982 | Mongeon | 340/564 |
| 4,568,924 | * | 2/1986 | Withrich et al. | 340/587 |
| 4,611,197 | * | 9/1986 | Sansky | 340/522 |
| 4,710,750 | * | 12/1987 | Johnson | 340/522 |
| 4,808,972 | * | 2/1989 | Nicholls | 340/541 |
| 4,833,450 | | 5/1989 | Buccola et al. | 340/506 |
| 4,882,567 | | 11/1989 | Johnson | 340/522 |
| 5,216,410 | | 6/1993 | Pildner et al. | 340/509 |
| 5,475,365 | * | 12/1995 | Hoseit et al. | 340/522 |

FOREIGN PATENT DOCUMENTS

| | | |
|---|---|---|
| 0255812 | 2/1988 | (EP) . |
| 0259015 A2 | 3/1988 | (EP) . |
| 0337964 A1 | 10/1989 | (EP) . |
| 0373716 A2 | 6/1990 | (EP) . |
| 0581569 | 2/1994 | (EP) . |
| 0609043 | 8/1994 | (EP) . |
| 2060967 | 5/1981 | (GB) . |
| 2288681 | 10/1995 | (GB) . |

* cited by examiner

*Primary Examiner*—Daryl Pope
(74) *Attorney, Agent, or Firm*—Fish & Richardson P.C.

(57) ABSTRACT

An event detection device comprising a sensing means for generating an output signal in response to the detection of an event, the device comprising a fault monitoring system which comprises: comparator means for comparing the output signal with a threshold signal and for activating a timed sequence processor when the output signal exceeds the threshold signal on a first occasion, the time sequence processor being adapted to activate a fault indicating circuit after a predetermined time interval unless the sensing means generates an output signal in response to the detection of an event on a second occasion within the predetermined time interval.

15 Claims, 5 Drawing Sheets

EVENT DETECTION DEVICE WITH FAULT MONITORING CAPABILITY

FIELD OF THE INVENTION

This invention relates to event detection devices and more particularly to an event detection device having an anti-masking capability.

BACKGROUND ART

Event detection devices, for example, intrusion monitoring devices, are well known in the art. Typically they are used to detect unauthorized entry or intrusion into a protected space.

Commercially available intrusion monitoring devices can be either of the passive or active variety. Passive intrusion monitoring devices can, for example, comprise a sensor which detects infra red radiation propagated by warm blooded animals. Typically such passive devices comprise a thermal detection device, consisting of one of more thermal detectors adapted to detect infra red radiation incident thereon, and an optical system for directing incident radiation from a plurality of angular fields of view towards the thermal detection device. Such optical systems may consist of lenses, particular Fresnel lenses and/or reflecting surfaces. Normally such devices are activated when a source of infra red radiation passes from one angular sector to the next. Typical prior art intrusion monitoring devices are illustrated in U.S. Pat. Nos. 3,703,718 and 3,958,118, and in UK patent number 1335410. The entire disclosures of all these patents are included herein by reference for all purposes.

Active intrusion monitoring devices are also known which comprise a transmitter and a receiver, the transmitter emitting radiation at a defined frequency and a receiver measuring the Doppler shift in any reflective radiation. Such active devices can, for example, operate at microwave frequencies, using a microwave radiation detection device to detect the reflective radiation.

Whatever detection device is used, it is necessary in each case to provide an electrical circuit to process the electrical output signal of the detection device and to compare that signal with a pre-set threshold signal.

The above devices can be used alone, or as a combined technology event detection device. Examples of such combined devices including specifically a combination of a photo electric sensor and a microwave sensor are shown in U.S. Pat. Nos. 3,725,888 and 4,401,976, the entire disclosures of which are incorporated herein by reference for all purposes.

In a typical combined technology event detection device, the outputs of two independent sensing means, responding to different physical stimuli, are supplied to an AND gate, and if both sensing means register an event within a specified period of time, then an alarm is triggered. In this manner the incidence of false alarms occurring when only a single sensor means is used can be greatly reduced.

A problem with both single and combined technology event detection devices is that if the detector is masked, for example, by placing a screen in front of the detector which will absorb the microwave signals emitted by the microwave device, or which will block infra red signals and prevent them from reaching the passive infra red sensor, the event detection device is rendered inoperable.

Attempts have been made to overcome this problem by providing the event detection device with a separate system comprising an infra red LED emitter and a detector which operate at a frequency range different from that of the passive infra red sensor. If an object is placed near the event detection device so as to mask the passive infra red sensor, the infra red LED/detector system will detect the presence of the object and cause an alarm to be triggered.

Such anti-masking system increase the expense of the device, and in some circumstances are ineffective, because it is still possible to mask all or part of the Fresnel lens associated with the passive infra red sensor without traversing the light beam from the infra red LED. Thus a skilful thief can mask the lens without activating the anti-masking system.

U.S. Pat. No. 4,833,450 discloses an event detection in which the alarm is sounded if a signal from a masking circuit exceeds a threshold level. The alarm continues to sound for a predetermined period. Once the predetermined period has lapsed and the correct of operation of the event detection device has been confirmed, the alarm is reset.

SUMMARY OF THE INVENTION

The present invention provides an event detection device provided with a fault monitoring system, such that, when the event detection device is connected to an alarm system, and the alarm system is armed, the event detection device will indicate a fault condition if the device has been tampered with or is defective, or has been accidentally or deliberately masked.

The invention provides an improved fault monitoring system for an event detection device wherein the fault monitoring and/or anti-masking system is activated by a signal generated by the event detection device.

According to the present invention there is provided an event detection device comprising a sensing means for generating an output signal in response to the detection of an event, and a fault monitoring system responsive to the output signal for indicating the presence of a fault, masking, or tampering with the device, wherein the fault monitoring system is responsive to an output signal from the sensing means indicating the detection of an event proximate to the event detection device.

In a first aspect, the invention provides an event detection device comprising a sensing means for generating an output signal in response to the detection of an event, the device comprising a fault monitoring system which comprises:

comparator means for comparing the output signal with a threshold signal and for activating a timed sequence processor when the output signal exceeds the threshold signal on a first occasion, the timed sequence processor being adapted to activate a fault indicating circuit after a predetermined time interval unless the sensing means generates an output signal in response to the detection of an event on a second occasion within the predetermined time interval.

The invention is applicable to both single technology and combined technology event detection devices.

In a second aspect, the invention provides a combined technology event detection device which comprises a first sensing means for generating a first output signal in response to the detection of an event, a second sensing means for generating a second output signal in response to the detection of an event, logic means for receiving the first and second output signals and for generating an alarm in response thereto, and a fault monitoring system comprising:

comparator means for comparing the first output signal with a threshold signal and for activating a timed sequence processor when the output signal exceeds the threshold signal on a first occasion, the timed sequence processor being adapted to activate a fault indicating circuit after a predetermined time interval unless the first sensing means generates a first output signal in response to the detection of an event, and the second sensing means generates a second output signal in response to the detection of an event, within the predetermined time interval.

The event detection device may be of the type used, for example, to detect movement and/or body temperature, and may be, for example, an intrusion detection device. Other uses of the device are, however, also possible. The invention is applicable to single technology event detection devices, for example, passive infra red sensor devices, and to combined technology event detection devices, for example, those comprising a passive infra red sensor and a Doppler shift microwave sensor, for example, of the type sold by Pyronix Limited under the trade mark EQUINOX. More than two sensing means may be used where necessary or desired, in which the case the logic means may generate an alarm in response to the summation of the output signals received from two or more of the sensing means.

The logic means may be included within one or more micro processors which can interrogate the sensing means for activity. The logic means can comprise any suitable logical algorithm, for example, a logic 'AND' function or a pulse counting function.

Preferably the output signal from the sensing means is fed into a two-stage amplifier and the comparator means is connected to the output from the first stage of the two-stage amplifier. In such an arrangement, the output from the second stage of the two-stage amplifier may be connected to a second comparator means for comparing the amplified output signal with a second threshold signal. The second comparator means may have an output state and be adapted to change said output state when the amplified electrical output signal traverses the second threshold signal, the changed output state indicating an alarm condition.

Preferably the timed sequence processor has a first passive state for a period wherein the sensing means is allowed to return to a passive or inactive condition, and a second active state for a period wherein the timed sequence processor interrogates the sensing means in order to detect an output signal from the sensing means in response to the detection of an event. If an output signal indicating a distant event is received the timed sequence processor is re-set and that sequence terminated. If an output signal indicating a proximate event is received, the timed sequence processor is re-set and re-started. If no output signal is detected, the timed sequence processor activates a fault indicating circuit which remains in an activated state until switched off. In a preferred embodiment according to the invention, the fault indicating circuit is rendered inactive by the generation of an output signal from the sensing means in response to the detection of a further distant event.

Preferably, if the fault indicating circuit is activated, the output state of the second comparator, or other alarm circuit, is also changed to indicate an alarm condition.

The predetermined time interval can be of any convenient length, and, for example, time periods within the range of from 5 seconds to 5 minutes have been found to be suitable. Preferably the time interval is around 30 seconds, with a passive state of 15 seconds and a further active state of 15 seconds.

The comparator means and timed sequence processor can be included in one or more micro processors as appropriate.

The fault indicating circuit can comprise a visual indication means, for example an LED, or may simply provide an electrical signal, for example, it can comprise a switch which remains open circuit whilst activated.

The event detection device of the invention can also comprise a fault monitoring system in accordance with International Patent application No. WO95/28692, the entire disclosure of which is incorporated herein by reference for all purposes. The outputs of the two fault monitoring systems can be combined or separate.

DESCRIPTION OF DRAWING

Embodiments of event detection devices according to the invention will now be more particularly described, by way of example only, with reference to the accompanying Drawings in which.

Figure 1:
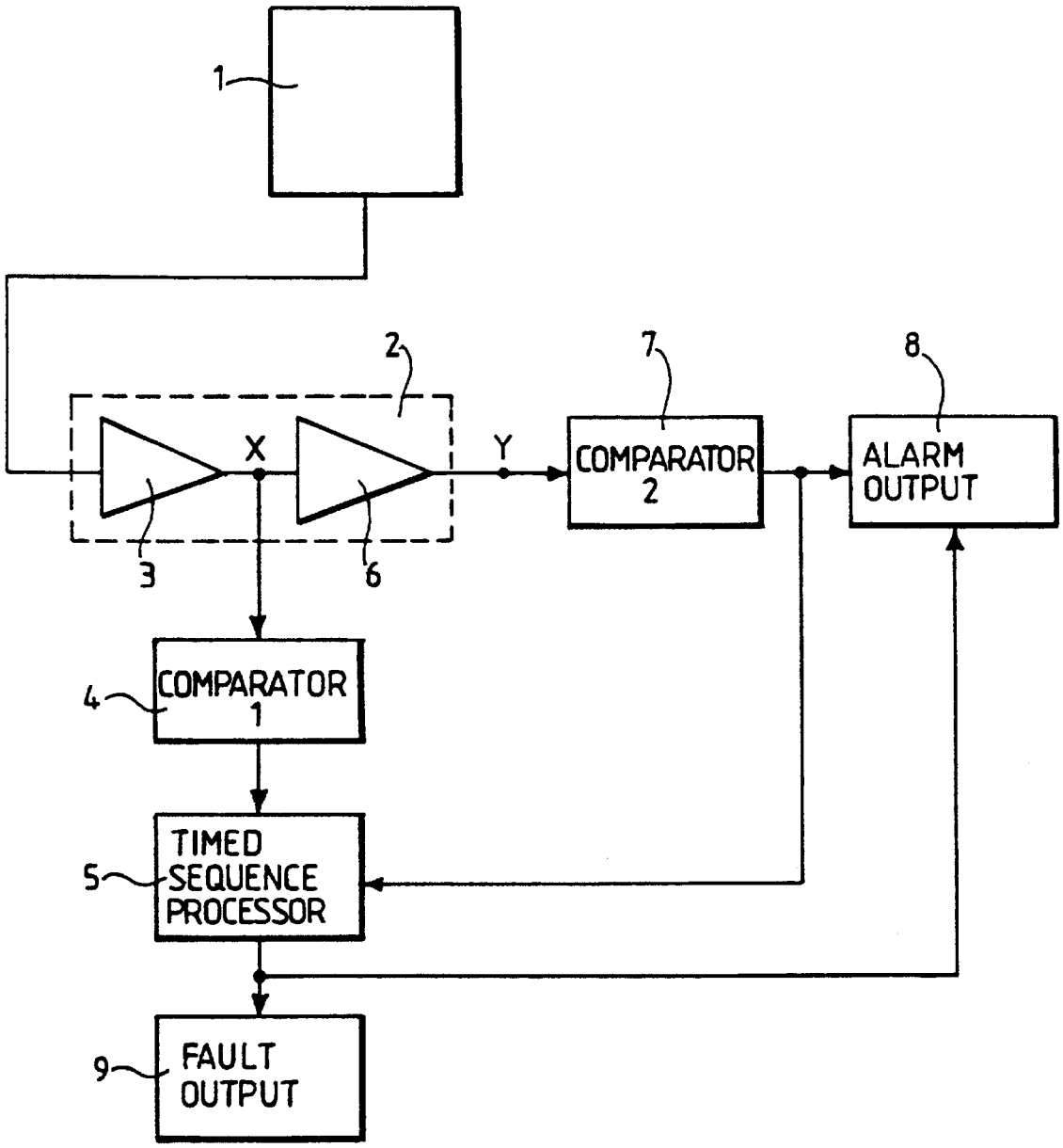
FIG. 1 shows a schematic block diagram of a single technology event detection device according to the invention.

Referring firstly to FIG. 1, there is shown a passive infra red sensor 1 having an output connected to a two-stage amplifier 2. The output of the first stage 3 of the two-stage amplifier 2 is connected to a first comparator 4 which in turn is connected to a timed sequence processor 5.

The output of the second stage 6 of the two-stage amplifier is connected at point Y to a second comparator 7. The output of the second comparator 7 is connected to the timed sequence processor 5, and to an alarm output 8.

The output of the timed sequence processor 5 is connected to a fault output 9 and to the alarm output 8.

The signals at points X and Y in FIG. 1, corresponding to the detection of an event, are illustrated in FIG. 3. FIG. 3*a* shows the signal at point X when an event is detected by the passive infra red sensor 1 at a distance of 10 meters or more. The signal, though amplified by amplifier stage 3, is still extremely small. The same signal, after passing through amplifier stage 6 is shown in FIG. 3*b*. It can be seen that the signal exceeds the threshold $t_1$ and is sufficient to give a signal from the second comparator 7 to alarm output 8. If, however, the system to which the event detection device is connected is not armed, no alarm is sounded, and the device will return to its inactive state after a pre-set interval, usually about 1 second.

Figure 3A:
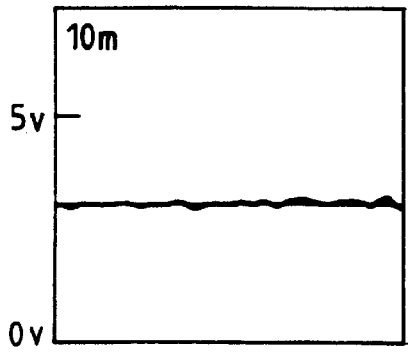
FIGS. 3(*a*), (*b*), (*c*) and (*d*) shows the signals at points X and Y in FIG. 1 when an event is detected at 10 meters and at 50 cm.
Figure 3B:
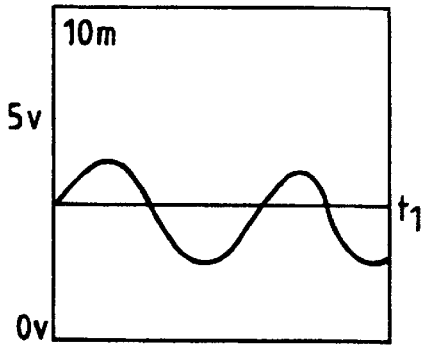
Figure 3C:
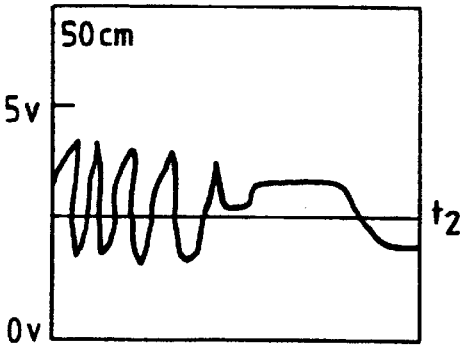
Figure 3D:
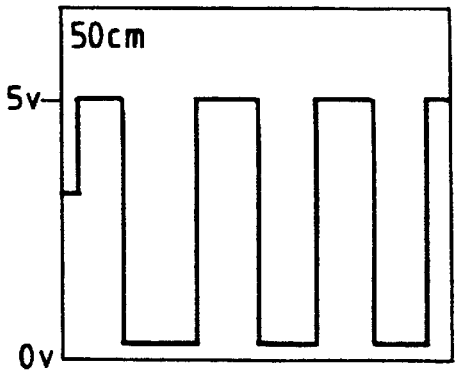
Figure 4A:
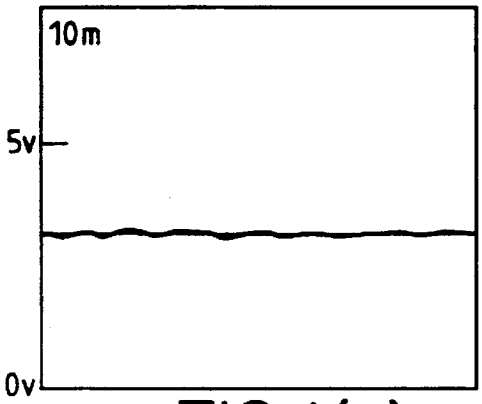
FIG. 4 shows the signals at points X and Y in FIG. 2 when an event is detected at a distance of 10 meters and at 50 cm.
Figure 4B:
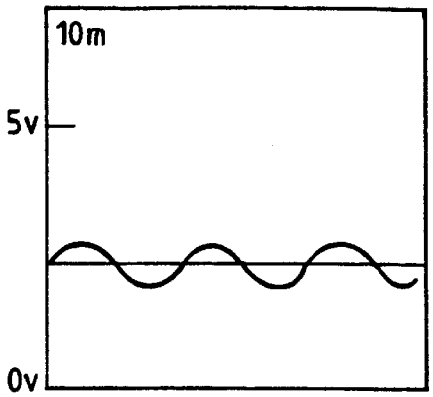
Figure 4C:
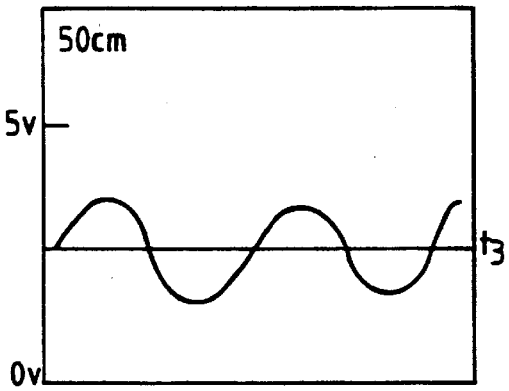
Figure 4D:
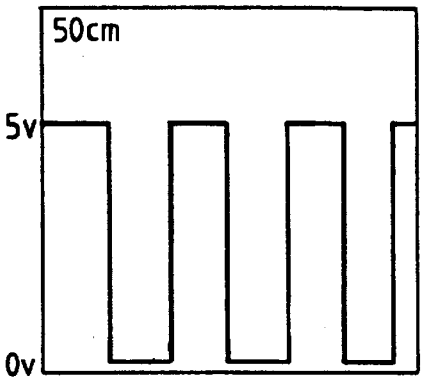

The effect of an event being detected at 50 cm distance, or less, is shown in FIGS. 3*c* and 3*d*. From FIG. 3*c* it can be seen that the signal at point X, the output of the first amplifier stage 3, is quite large, but irregular. The signal at point Y, the output of the second amplifier stage, has overloaded the system. This larger signal will, of course, also activate the alarm output via the comparator 7. However, because the signal at point X, is also greater than the threshold $t_2$ of the first comparator 4, the timed sequence processor 5 will also be activated.

The timed sequence processor 5 has a passive state lasting for about 15 seconds to allow the passive infra red sensor to return to its inactive condition. There follows a further 15 seconds when the timed sequence processor waits for a signal from comparator 7 to confirm that the processor 5 can be re-set. If a signal indicating a distant event (10 m) is received, the processor is re-set and the sequence terminated. If a signal indicating a proximate event (50 cm) is received, the processor is re-set and the sequence re-started. If no such signal is received, either because there is a fault in the system, or because the passive infra red sensor 1 has been masked, the timed sequence processor 5 sends an output signal indicating a fault condition to a fault indicating output 9.

Unlike the alarm output, which last only for about 1 second, the circuit 9 indicating the fault remains active, such that when the alarm system to which the event detection device is connector is armed, the fault condition continues to be indicated, and will inform the alarm system until the fault is corrected. Similarly, because the timed sequence processor is also connected to the alarm output 8, the alarm circuit will also remain activated.

It can be seen that, in this way, the passive infra red sensor cannot be disabled by masking whilst the alarm system is un-armed, without this fact becoming apparent to an operator seeking to arm the system.

Figure 2:
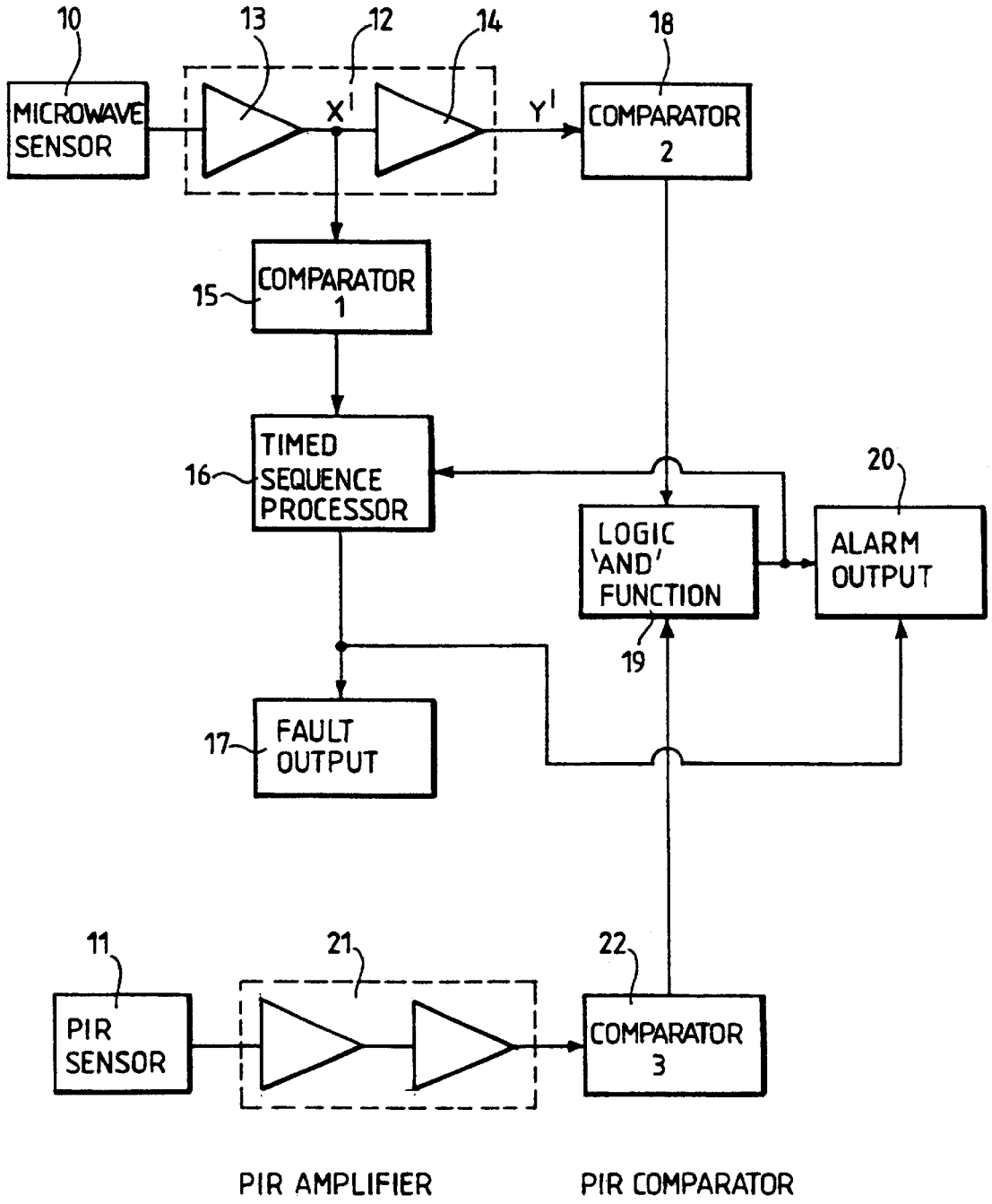
FIG. 2 shows a schematic block diagram of a combined technology event detection device according to the invention.

Referring now to FIG. 2, there is shown a combined technology event detection device comprising a microwave sensor 10 and a passive infra red sensor 11. The output of the microwave sensor 10 is connected to the input of a first two-stage amplifier 12, having a first stage 13 and a second stage 14.

The output from the first stage 13 is connected at point X' to a first comparator 15, which is connected to a timed sequence processor 16, which in turn is connected to a fault output 17.

The output from the second stage 14 of the two-stage amplifier 12 is fed at point Y' into a second comparator 18, and from thence to a logic 'AND' function 19 which is connected to the timed sequence processor 16 and to an alarm output 20. The output of the timed sequence processor 16 is also fed to the alarm output 20.

The output from the passive infra red sensor 11 is connected to the input of a second two-stage amplifier 21, the output of which is fed to a third comparator 22. The third comparator 22 is connected to the logic 'AND' function 19.

The signals at points X' and Y' due to the detection of an event are shown in FIG. 4. When an event is detected at a distance of 10 meters by the microwave sensor 10, a very small signal is observed at point X' as shown in FIG. 4(*a*). This signal is amplified by the second stage 14 of the amplifier 12, and appears as shown in FIG. 4(*b*) at point Y'.

The effect of an event detected by microwave sensor 10 at a distance of 50 cm or less is shown in FIG. 4(*c*) and FIG. 4(*d*). In FIG. 4(*c*), it can be seen that there is a substantial signal at point X' which has exceeded the threshold $t_3$. The signal at point Y', shown in FIG. 4(*d*), is sufficient to produce an overload condition.

Figure 5:
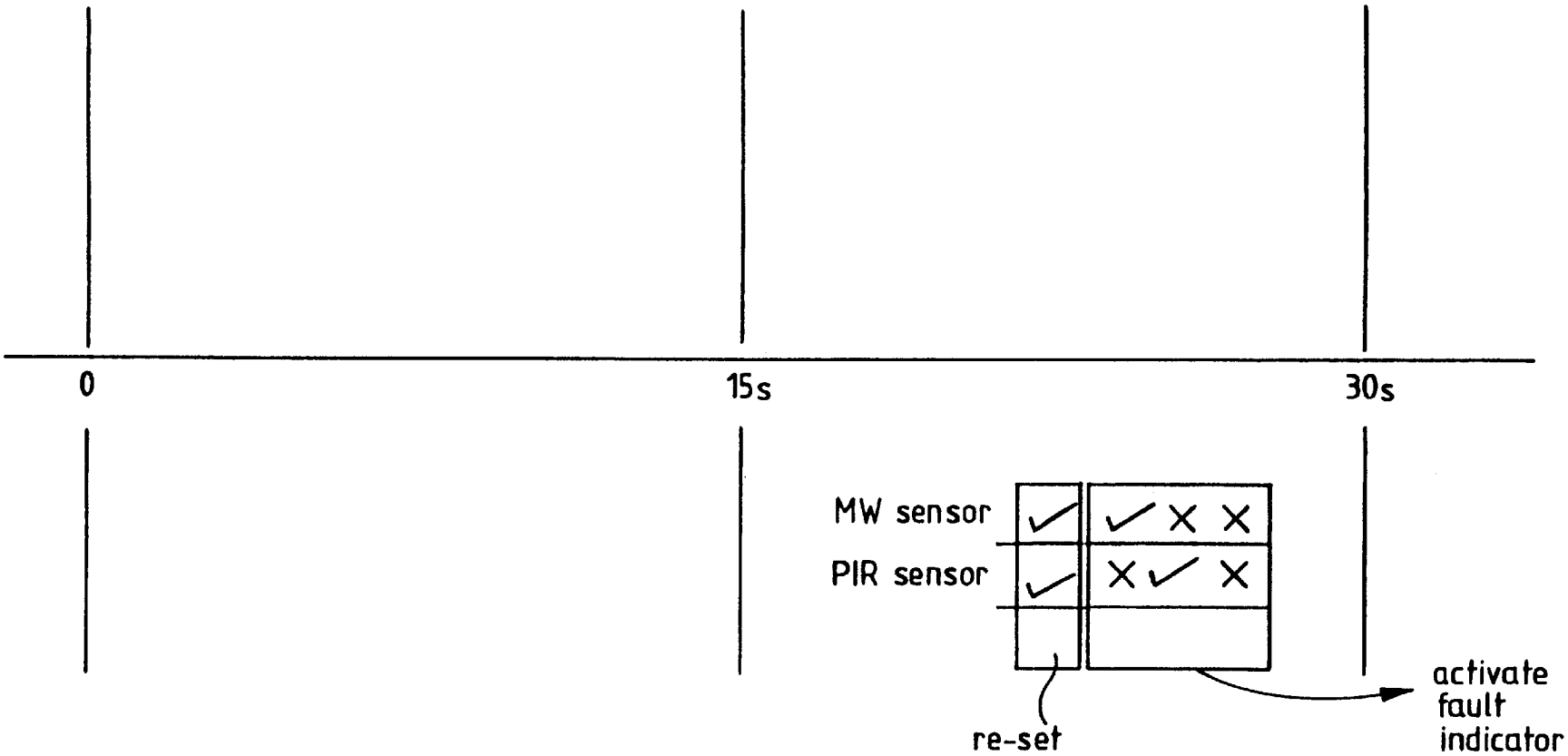
FIG. 5 shows a graph of the time sequence of the timed sequence processor indicating the possible steps following the detection of an event.

Because the signal at point X' has exceeded the threshold $t_3$ of the comparator 15, the timed sequence processor 16 is activated. A graph of the timed sequence in shown in FIG. 5.

For the first 15 seconds the sequence processor 16 remains in a passive state, waiting for the microwave sensor 10 to return to its inactive condition. For the next 15 seconds the timed sequence processor 16 interrogates both the microwave sensor 10 and the passive infra red sensor 11, through the logic 'AND' function output, seeking confirmation of the event. If both sensors indicate that a distant event has occurred within the second 15 second period, the timed sequence processor is re-set and returns to its waiting condition. This is indicated by 2 ticks in the block diagram in FIG. 5.

If, in the second 15 second period, only one of the sensors 10, 11 indicates that an event has occurred (one tick and a cross), or neither sensor indicates that an event has occurred (two crosses), at the end of the period the timed sequence processor 16 will send a signal to a fault output circuit 17. The fault output circuit 17 remains open until the fault has been corrected. If the microwave sensor indicates that a proximate event has occurred, the timed sequence processor is re-set and re-started.

Because the time sequence processor 16 is connected to both the fault output 17 and the alarm output 20, both will remain activated until the processor is re-set.

It should be stressed that the fault monitoring system is activated only when a signal is received indicating that an event has been detected within a short distance from the sensor, and the timed sequence processor would normally be re-set by the detection of a further distant event within its second 15 sec period of operation. Only if the timed sequence processor does not receive confirmation of an event within its second 15 second period will the fault output circuit be activated.

Throughout the operation of the fault monitoring system the device will continue to operate as a combined technology event detection device, and if both sensors 10, 11 indicate that an event has occurred simultaneously the alarm output 20 will be activated via the logic 'AND' function 19.

Whilst the fault monitoring system of the present invention may be useful in detection electrical faults in, or tampering with, the event detection device, its most important application is as an anti-masking system in the prevention of accidental or deliberate masking of the event detection device, which, for the purposes of this specification, is also described herein as a fault condition.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiments. The invention extends to any novel one, or any novel combination, of the features disclosed in this specification (including any accompanying claims, abstract and drawings), or to any novel one, or any novel combination, of the steps of any method or process so disclosed.

What is claimed is:

1. An event detection device, comprising:

a first sensor to generate a first output signal in response to the detection of an event, the first sensor generating a second output signal to prevent activating a fault indicating circuit upon detecting the event on a second occasion within a predetermined time interval; and a comparator to compare the first output signal with a threshold signal and activate a timed sequence processor when the first output signal exceeds the threshold signal on a first occasion, the timed sequence processor being adapted to activate the fault indicating circuit after the predetermined time interval unless the first sensor generates the second output signal in response to the detection of an event on the second occasion within the predetermined time interval.

2. An event detection device according to claim 1 wherein the device further comprises a second sensor to generate a second output signal in response to the detection of an event, logic to receive the first and second output signals and to generate an alarm in response thereto, and a fault monitoring system having a comparator to compare the first output signal with a threshold signal and to activate the timed sequence processor when the first output signal exceeds the threshold signal on a first occasion, the timed sequence processor being adapted to activate a fault indicating circuit after a predetermined time interval unless the first sensor generates another first output signal in response to the detection of an event, and the second sensor generates another second output signal in response to the detection of an event, within the predetermined time interval.

3. An event detection device according to claim 1 to detect an intrusion.

4. An event detection device according to claim 1, wherein the first sensor is a passive infra red sensor.

5. An event detection device according to claim 1, wherein the first sensor is a Doppler shift microwave sensor.

6. An event detection device according to claim 1, further comprising a two stage amplifier in which the output signal from one amplifier and the comparator is connected to the output from the first stage of the two-stage amplifier.

7. An event detection device according to claim 1, in which the timed sequence processor has a first passive state for a period wherein the first sensor is allowed to return to a passive or inactive condition after the detection of an event, and a second active state for a period wherein the timed sequence processor interrogates the first sensor in order to detect an output signal from the first sensor in response to the detection of an event.

8. An event detection device according to claim 1, in which the arrangement is such that, when the timed sequence processor is activated, if an output signal indicating a distant event is received the timed sequence processor is re-set and that sequence terminated, and if an output signal indicating a proximate event is received the timed sequence processor is re-set and re-started, and if no output signal is detected the timed sequence processor activates a fault indicating circuit.

9. An event detection according to claim 1, in which the fault indicating circuit is rendered inactive by the generation of an output rendered inactive by the generation of an output signal from the first sensor in response to the detection of a distant event.

10. An event detection device according to claim 1, in which, if the fault indicating circuit is activated, the output state of a second comparator, or other alarm circuit, is also changed to indicate an alarm condition.

11. An event detection device according to claim 1, in which the predetermined time interval is from 5 seconds to 5 minutes.

12. An event detector according to claim 1, further comprising one or more additional sensors coupled to the timed sequence processor to generate one or more confirmatory output signals in response to the event.

13. An event detection device, comprising:

a sensor to generate an output signal in response to the detection of an event, the sensor generating a second output signal to prevent activating a fault indicating circuit upon detecting the event on a second occasion within a predetermined time interval; and a timed sequence processor coupled to the sensor and adapted to be triggered on a first occasion to activate a fault indicating circuit after the predetermined time interval unless the sensor generates the second output signal in response to the detection of an event on a second occasion within the predetermined time interval; and one or more additional sensors coupled to the timed sequence processor to generate one or more confirmatory output signals in response to the event.

14. An event detection device according to claim 13, further comprising a combining device positioned between the timed sequence processor and the sensors to supply output signals from the sensors to the timed sequence processor in response to the event.

15. An event detection device according to claim 14, wherein the combining device is an and device.

* * * * *